United States Patent [19]

Macias

[11] Patent Number: 4,838,627

[45] Date of Patent: Jun. 13, 1989

[54] DRAWER MOUNTING MEANS

[75] Inventor: Jorge Macias, West Covina, Calif.

[73] Assignee: Russ Bassett Company, Whittier, Calif.

[21] Appl. No.: 158,533

[22] Filed: Feb. 22, 1988

[51] Int. Cl.[4] ..... A47B 88/00

[52] U.S. Cl. ..... 312/341 R; 312/330 R

[58] Field of Search ..... 312/330 R, 341 R, 333, 312/334, 335, 338

[56] References Cited

U.S. PATENT DOCUMENTS

| | | | |
|---|---|---|---|
| 4,067,632 | 1/1978 | Sekerich | 312/341 R |
| 4,440,461 | 4/1984 | Powell et al. | 312/338 X |
| 4,473,262 | 9/1984 | Staye | 312/333 |
| 4,475,778 | 10/1984 | Stark | 312/333 X |

*Primary Examiner*—Joseph Falk

*Attorney, Agent, or Firm*—George J. Netter

[57] ABSTRACT

A drawer for mounting within a cabinet via telescoping slide parts, one part of which is affixed to an inner cabinet wall. The drawer has metal side panels, each of which has an upper edge bent into a flange forming a guideway with the flange having an opening and the adjacent drawer panel includes a lance. The other side part having an offset limit received within the drawer panel flange opening and an opening for receiving the drawer panel lance thereby securing the drawer and slide parts together.

2 Claims, 1 Drawing Sheet

10
11
12
13
14
15
16
17
18
19
20
21
22
23
24
25
26
27
28
2
4

DRAWER MOUNTING MEANS

The present invention relates generally to a drawer, and, more particularly, to means for mounting a drawer to an extendible slide affixed to a wall surface in a cabinet within which the drawer is located.

BACKGROUND OF THE INVENTION

Drawers in many cabinets and desks, particularly in so-called filing cabinets, are typically mounted to a slide assembly which is affixed to the side walls of the cabinet including an extendible slide part by which the drawer can be selectively moved to either the closed or open positions. Such slide assemblies are typically interconnected with the drawer via a relatively complex rail arrangement which is not only difficult to assemble, but also relatively expensive to manufacture.

SUMMARY OF THE INVENTION

The drawer slide assembly with which the present invention is most advantageously utilized includes three parts releasably and telescopingly joined to one another. One slide part is fixedly secured to a cabinet inner wall defining the drawer containing space by threaded means or any other suitable manner. The second slide part is telescopingly arranged with the first part via tracks and bearings and a third intermediate slide part permitting ready sliding extension of the second part from the first and second parts. In a way to be described, the drawer is secured to the slide second or intermediate part such that the drawer can be moved from one extreme in which the drawer is open to a second extreme where it is fully received within the cabinet.

In a preferred embodiment the drawer consists of metal side panels each having an upper edge portion which is rolled outwardly to provide a flange with a turned down outer edge extending generally parallel to the panel side wall. An opening is formed in the flange by piercing the metal and an offset tab is lanced in the sidewall and bent outwardly of the drawer panel sidewall. The second slide part is generally dimensioned to enable receipt within a drawer side panel flange. The second slide part is also modified to include an offset limit and an opening spaced therefrom, which are so located as to position the offset limit within the flange opening and to receive the offset tab in the second slide part opening. In this manner the drawer can be rapidly and easily locked to two second slide parts (one at each drawer side) for unitary movement therewith.

DESCRIPTION OF A PREFERRED EMBODIMENT

Figures 1, 2, 3, 4:
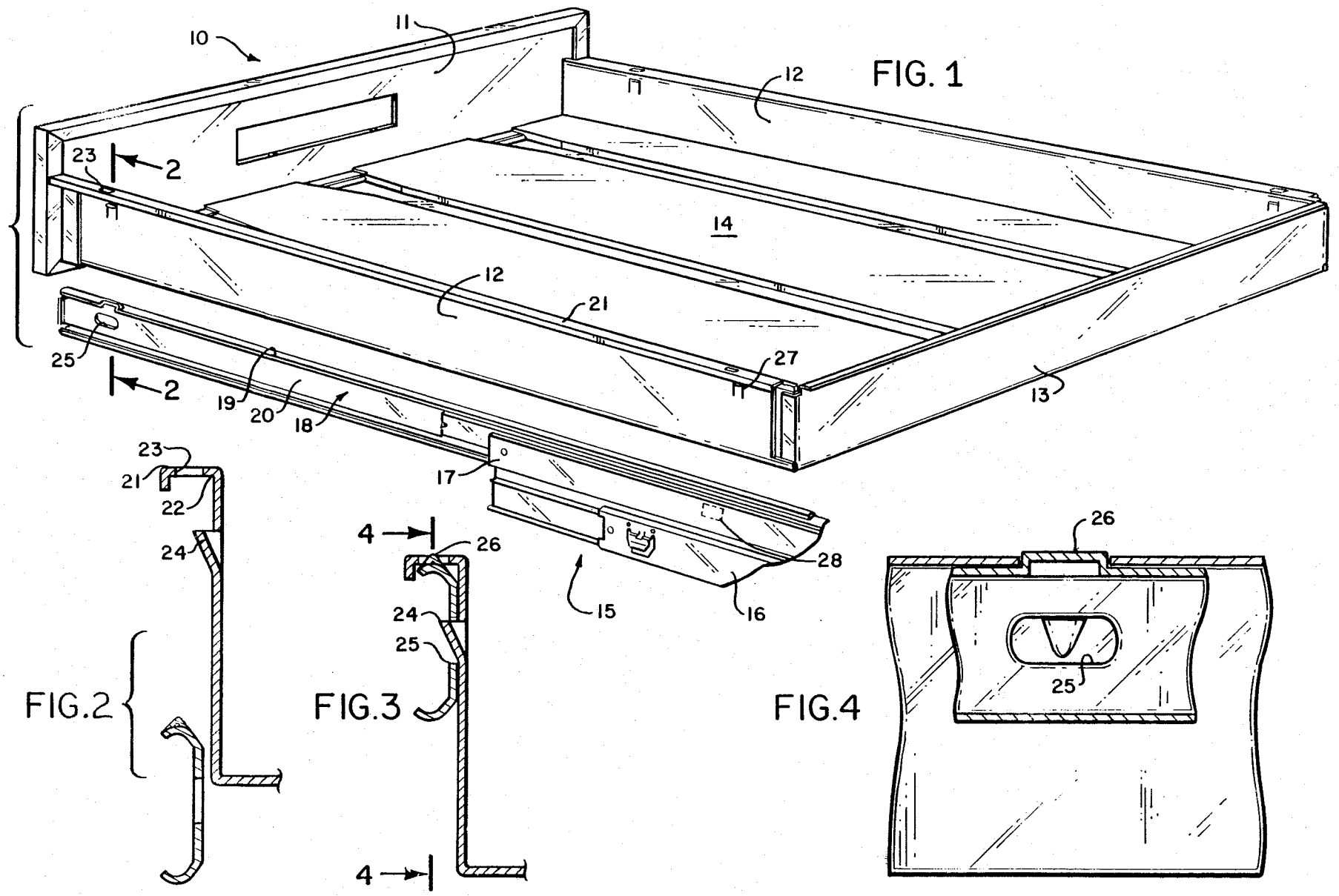
FIG. 1 is a perspective view of a drawer and slide assembly shown with the parts unassembled.
FIG. 2 is an elevational sectional view taken through the drawer and slide assembly along line 2—2 of FIG. 1.
FIG. 3 is a side elevational view similar to FIG. 2 showing the drawer and slide assembly assembled to one another.
FIG. 4 is a side elevational view taken along line 4—4 of FIG. 3.

Turning now to the drawings and particularly FIG. 1, a drawer 10 with which the present invention can be most advantageously employed is seen to include a front panel 11, two side panels 12, a rear panel 13, and a bottom 14. These various drawer panels and bottom can be joined together to form a unitary open-top drawer for mounting within a filing cabinet or desk, for example. A well-received present day technique for mounting a drawer within a cabinet, particularly a filing cabinet, is to provide a three-part slide assembly 15 affixed to each side of the drawer which secures the drawer to the inside surface of the cabinet facing the drawer side panels. The slide assembly includes telescoping parts enabling the drawer to be pulled to its open condition or returned to its closed position, as desired.

More particularly, as is shown best in FIG. 1, such a slide assembly 15 includes a first part 16 which is secured by a threaded means or bayonet, for example, to the inside surface of the cabinet enclosure facing the drawer (not shown) an intermediate second part 17, and third slide part 18 which is secured to the drawer 10 in a manner to be described. The three slide parts are telescopically arranged and slidingly extendible with respect to each other so that the third slide part and interconnected drawer can move from a fully extendible limit, to a second limit with the slide parts closed onto each other. The third slide part 18 has an elongated, generally rectangular, flat surfaced rail 19 extending along an upper longitudinal edge of a generally flat metal panel 20.

The first and second slide parts 16 and 17 details are not given since they are not important for understanding and operation of the present invention.

An excellent and widely used slide assembly for present purposes is available on the market and can be purchased under the trade designations 400 and 4000 Series manufactured and sold by Accuride, Santa Fe Springs, Calif.

In the past, it has been standard to mount such a slide assembly to a drawer through the intermediary of relatively complex and expensive apparatus including guideways secured to the drawer side panels along which the third slide part releasably guided. This known drawer mounting apparatus also requires the expenditure of relatively skillful labor for affixing either by threaded means, rivets or other such means, to the drawer side panel. It is a primary desideratum of the present invention to eliminate the necessity for use of such special, complex and relatively expensive guideways on a drawer side panel and, in that way, to reduce manufacturing and installation costs.

It is preferable for best operation of the present invention that the drawer side panels 12 be constructed of metal sheets or plates, generally rectangular in shape, having an upper edge portion which is formed outwardly into a horizontal flange 21 with the outer edge turned downwardly a slight amount such that the flange includes a lower track or guideway 22 closely adjacent to and extending along the drawer side panel. More particularly, the guideway 22 is so dimensioned as to enable sliding receipt of the second slide part rail 19 therewithin.

During fabrication of a side panel 12, the upper surface of the flange is pierced to form an opening 23 at a point spaced from the front panel 11 an amount dependent upon the overall length of the third slide member as well as the amount of extension that the drawer is designed for as will be more specifically discussed later herein. The side panel 12 is also pierced along a generally U-shaped line to form a lance 24 that can be bent outwardly from the side panel plane. The lance has a kickout at the top with lead in at the bottom (FIG. 4) and is so located with respect to the opening 23 as to align with an opening 25 in the third slide part 18 when the drawer and slide part are assembled together.

In addition to the opening 25, a part of the rail 19 is modified by piercing to form an upwardly extending offset limit 26 for tightly and lockingly fitting into the side panel flange opening 23.

There are two slide assemblies for each drawer (one at each side of the drawer), but the mounting of only one is described since it is identical for the other. To mount the drawer within the cabinet, first the slide assembly has its first slide part 16 secured onto an inner wall of the cabinet in a suitable manner. Next, the telescoping second and third slide parts are pulled to their fully extended position and the flange guideway 22 is slid along the third part rail 19 until the offset limit 26 snaps into opening 23. When so positioned the side panel lance 24 is simultaneously received in opening 25 in the third slide part 18. More particularly, the relative dimensions are such that the lance and offset, when snapped into place as described, lockingly secure the third slide part and drawer side panel together for unitary movement into and out the drawer cabinet.

As an alternative version, an additional lance 27 is formed in the drawer side panel which during assembly is lockingly received within a similar dimensioned opening 28 in the second slide part panel. This version provides enhanced anchoring and securing of the drawer side panel to the third slide part, and, more particularly, this serves to prevent tipping of the drawer when extended.

What is claimed is:

1. Means for mounting a cabinet drawer to a slide assembly having a first slide part for securement to the cabinet, a second intermediate slide part, and a third slide part with a side panel having an opening therein and an elongated rail mounted on an edge of said side panel, said slide arts being selectively extendibly related to each other, comprising:

the drawer has first and second side walls each of which side walls includes a metal sheet with an upper edge formed into a flange of generally U-shaped cross-section defining a guideway of such dimensions as to enable sliding receipt of the third slide part rail therewithin;

an opening formed in the drawer flange;

a portion of the third slide part rail extending into the flange guideway for lockingly engaging within the flange opening; and a portion of the drawer side wall being formed into a lance bent away from said side wall for being lockingly engaged within the opening in the side panel of the third slide part when the second slide part is in the guideway and engaging the portion of the third slide part rail extending into the flange guideway.

2. Means as in claim 1, in which each drawer side wall has a front end and a rear end; a further opening and further lance formed in the drawer flange and side wall, respectively, adjacent the rear; a further opening in the third slide part for receiving the further lance therein; and a further portion of the third slide part rail extending into the flange guideway for receipt in the further drawer flange opening.

* * * * *